US006206309B1

(12) United States Patent
Danielsson et al.

(10) Patent No.: US 6,206,309 B1
(45) Date of Patent: Mar. 27, 2001

(54) METHOD AND DEVICE FOR TREATMENT OF FIBROUS MATERIAL

(75) Inventors: Ove Danielsson, Stockholm (SE); Ola Johansson, Brockfield, WI (US); Peter Svedberg, Sundsbruk (SE)

(73) Assignee: Valmet Fibertech Aktiebolag (SE)

( * ) Notice: Subject to any disclaimer, the term of this patent is extended or adjusted under 35 U.S.C. 154(b) by 0 days.

(21) Appl. No.: 09/367,962

(22) PCT Filed: Feb. 3, 1998

(86) PCT No.: PCT/SE98/00183

§ 371 Date: Aug. 23, 1999

§ 102(e) Date: Aug. 23, 1999

(87) PCT Pub. No.: WO98/36836

PCT Pub. Date: Aug. 27, 1998

(30) Foreign Application Priority Data

Feb. 25, 1997 (SE) ..... 9700676

(51) Int. Cl.[7] ..... B02C 7/00

(52) U.S. Cl. ..... 241/247; 241/246; 241/261.2; 241/261.3

(58) Field of Search ..... 241/246, 247, 241/261.2, 261.3

(56) References Cited

U.S. PATENT DOCUMENTS 3,902,673 * 9/1975 Berggren ..... 241/246
3,957,214 * 5/1976 Berggren ..... 241/246
4,220,290 * 9/1980 Johansson ..... 241/247
4,253,613 3/1981 Reinhall .
5,040,736 8/1991 Obitz .

FOREIGN PATENT DOCUMENTS 150727 8/1984 (NO) .
467 463 7/1992 (SE) .

* cited by examiner

*Primary Examiner*—Allen M. Ostrager
*Assistant Examiner*—William Hong
(74) *Attorney, Agent, or Firm*—Lerner, David, Littenberg, Krumholz & Mentlik, LLP

(57) ABSTRACT

Methods and apparatus are disclosed for refining lignocellulosic material between a pair of relatively rotary refining elements forming an annular outer refining zone and a central feed zone. The method includes feeding the lignocellulosic material to the central feed zone, accelerating the lignocellulosic material through the central feed zone towards the annular outer refining zone without lignocellulosic material build up in the central feed zone and substantially without working the lignocellulosic material in the central feed zone, the density of the lignocellulosic material in the central feed zone being a maximum of about 10 kg/m$^3$, and mechanically working the lignocellulosic material in the annular outer refining zone, and in which the relatively rotary refining elements have a relative speed of greater than about 50 m/sec.

6 Claims, 2 Drawing Sheets

METHOD AND DEVICE FOR TREATMENT OF FIBROUS MATERIAL

FIELD OF THE INVENTION

The present invention relates to a method and apparatus for treating lignocellulosic fibrous material in a refiner with opposed refining means rotating relative to each other, one of which is stationary and one rotary, and which are preferably provided with refining elements, which form a refining gap with a refining zone for working the material therebetween. The present invention also relates to such method and apparatus in which the material is supplied to a feed zone located radially inside the refining zone. The present invention also relates to a feeding device for the lignocellulosic material.

The present invention more particularly relates to the manufacture of various types of mechanical pulps, such as refiner mechanical pulp (RMP), thermomechanical pulp (TMP), chemi-mechanical pulp (CMP) and chemi-thermo-mechanical pulp (CTMP). The starting material in accordance with the present invention can be wood chips, one-year plants as wheat, straw, bagasse or more or less worked pulp.

BACKGROUND OF THE INVENTION

The working of fibrous material in the known refiners most often is carried out in an ineffective manner. A significant portion of the energy input to these refiners is used for transporting the fibrous material through the refiner, wherein friction and heat losses occur which do not result in the alterations of the fibrous material which are required for developing the pulp quality and for making the refining process effective. It is therefore apparent that the energy consumption is higher than that required for achieving the desired mechanical working; i.e., the desired pulp quality.

SUMMARY OF THE INVENTION

In accordance with the present invention, this and other problems have now been solved by the discovery of a method for refining lignocellulosic material between a pair of relatively rotary refining elements forming an annular outer refining zone and a central feed zone therebetween, the method including feeding the lignocellulosic material to the central feed zone, accelerating the lignocellulosic material through the central feed zone towards the annular outer refining zone without lignocellulosic material build up in the central feed zone and substantially without working the lignocellulosic material in the central feed zone, the density of the lignocellulosic material in the central feed zone being a maximum of about 10 kg/m$^3$, and mechanically working the lignocellulosic material in the annular outer refining zone wherein the relatively rotary refining elements have a relative speed of greater than about 50 m/sec. Preferably, the density of the lignocellulosic material in the central feed zone is a maximum of about 1 kg/m$^3$.

In accordance with the present invention, apparatus has also been discovered for feeding lignocellulosic material to a refiner including a pair of relatively rotary refining members including a corresponding pair of refining elements forming a refining gap and comprising an annular outer refining zone, and a central feed zone therebetween, a central feed conduit having a predetermined diameter for feeding the lignocellulosic material to the refiner, the apparatus including a feed member for mounting in the central feed zone in front of the central feed conduit, the feed member including a front axial screw and at least one substantially radial rear wing displaced rearwardly from the front axial screw, the front axial screw having a diameter substantially corresponding to the predetermined diameter, and the at least one rear wing adapted to extend into the refining gap substantially to the annular outer refining zone. Preferably, the pair of relatively rotary refining members includes a stationary refining member and a rotary refining member, the central feed conduit being disposed in the stationary refining member and the feed member being disposed on the rotary refining member. In a preferred embodiment, the apparatus includes between about 2 and 4 of the substantially radial rear wing members.

In accordance with oen embodiment of the appartus of the present invention, the at least one rear wing member includes an outer end which is curved from the intended direction of rotation of the rotary refining member.

The present invention offers a solution to the above problems, in that the residence time of the material in the feed zone is shortened, and substantially without mechanical working the cellulosic material passes through the feed zone to the radially outer refining zone. The residence time should be less than about 2.5 sec, preferably less than about 1 sec.

By means of a central feeding device the cellulosic material is fed in and accelerated outward without material build-up in the feed zone. In this manner, the material density in the feed zone is restricted to a maximum of about 10 kg/m$^3$, and preferably to a maximum of about 1 kg/m$^3$. In this way, contact of the material with the refining means in the feed zone is reduced, and thus the energy consumption in the form of frictional heat is reduced. Any proper mechanical working does not take place in the feed zone, and the energy consumption in this zone preferably should be less than about 5% of the total energy consumption.

Instead, the energy input is transferred to the refining zone, where the relative speed between the refining elements is now quite high, and preferably exceeds about 50 m/sec even in the inner portion of the refining zone.

BRIEF DESCRIPTION OF THE DRAWINGS

The present invention is described in greater detail in the following detailed description, which, in turn, refers to the accompanying drawings, in which.

DETAILED DESCRIPTION

Figure 1:
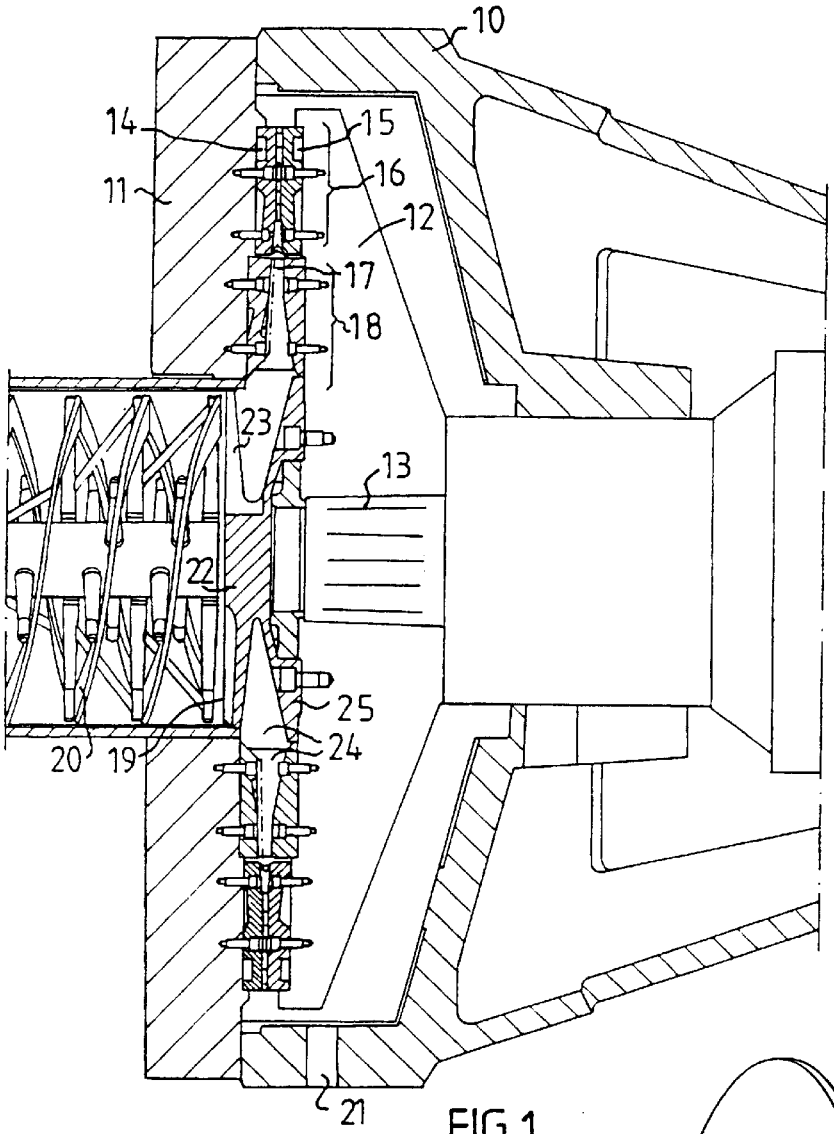
FIG. 1 is a side, elevational, cross-sectional view through a refiner for treating fibrous material according to the present invention.
Figure 2:
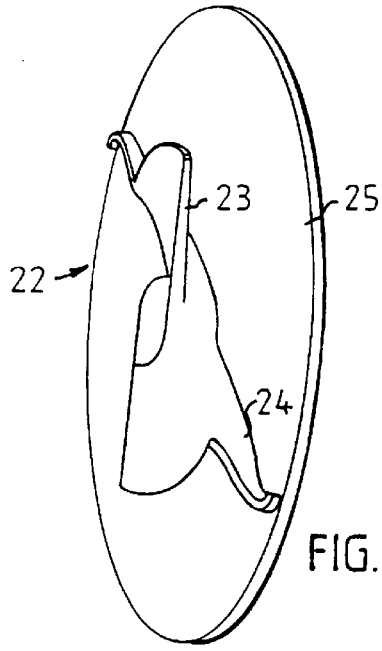
FIG. 2 is a side, perspective view of a feed device according to the present invention.

The refiner shown in FIG. 1 comprises a refiner housing 10, in which a stationary refining means 11 and an opposed rotary refiner means 12 attached on a rotary shaft 13 are provided. The refining means, 11 and 12, are provided with refining elements, 14 and 15, respectively, which between them form a refining zone 16 in a refining gap 17. The refining gap 17 includes an inwardly located feed zone 18. The stationary refining means 11 is formed with a central feed opening 19 for the material which is to be worked. A screw feeder 20 for the material is connected to the feed opening 19. The refiner housing 10 is provided with an outlet 21 for the material passing through the refining gap, where the material is worked into the form of a pulp.

A central feeding device 22 is located on the rotary refining means, and it is formed with a front axial screw 23 and at least one substantially radial rear wing 24 on a rear wall 25 of the central feeding device 22. The diameter of the axial screw 23 corresponds to the diameter of the feed opening 19. The rear wing or wings 24 extend into the refining gap 17 through the feed zone 18 out to the refining zone 16.

The feeding device 22 can be formed with an axial screw 23 and wings 24 either as one unit or as separate parts, which are attached individually to the rotary refining means 12.

The number of wings 24 is preferably 2 to 4, and they can be radial or formed with their radially outer ends curved from the rotation direction of the device.

The material to be treated is advanced to the refiner by means of the screw feeder 20. The design of the feeding device 22 with a front axial screw 23 ensures the transfer of the material from the screw feeder 20 to the refiner, since the material is prevented from rebounding out into the screw feeder 20. The presence of the rear wing or wings 24 also causes the material, which is fed by the axial screw 23 between the refining means, 11 and 12, to pass rapidly through the feed zone 18 to the radially outwardly located refining zone 16 where the working of the material into the form of a pulp takes place. The wings 24 thus accelerate the material outwardly without material build-up in the feed zone 18, in view of the fact that the material is locked up in a space, which is initially defined by the axial screw 23 and thereafter by the rear wall 25 of the feed device 22, an opposed substantially smooth portion on the stationary refining means 11 and wings 24. The material thus enclosed is subjected to an increasing centrifugal force, which throws the material outwardly to the refining zone. The material density in the feed zone 18 can thereby be restricted to a maximum of about 10 kg/m$^3$, preferably a maximum of about 1 kg/m$^3$. The contact of the material with the refining means in the feed zone, and the energy consumption in the form of frictional heat is thereby reduced. No proper mechanical working, thus, takes place in the feed zone 18, but it takes place in the refining zone 16. The energy consumption in the feed zone is preferably less than about 5% of the total energy consumption.

In the refining zone 16, where substantially the entire energy input occurs, the relative speed between the refining elements, 14 and 15, must be high, and preferably exceeds about 50 m/sec already in the inner portion of the refining zone.

EXAMPLE

A refiner of the type shown in FIG. 1 was operated partially with a conventional feeding device and partially with a feeding device according to the present invention for the manufacture of tissue pulp. The results are set forth in the following Table.

Regarding the load on the screw feeder 20, it was observed that it was about 40% lower with the feeding device according to the present invention, which indicates that this feeding device effectively draws in the material into the refiner and moves it out to the refining zone.

TABLE

| | CONVENTIONAL FEED | | | FEED ACCORDING TO THE INVENTION | | |
|---|---|---|---|---|---|---|
| Production ton/hour | 7.2 | 7.2 | 7.2 | 7.7 | 7.7 | 7.7 |
| Spec. energy kWh/hour | 1417 | 1333 | 1250 | 1013 | 974 | 974 |
| CSF ml | 469 | 542 | 612 | 514 | 574 | 596 |
| Tensile index kNm/kg | 15.6 | 17.3 | 15.3 | 19.0 | 16.5 | 16.1 |
| Tear index Nm$^2$/kg | 5.87 | 6.48 | 5.68 | 6.22 | 6.17 | 6.27 |

It can therefore be seen that the quality of the produced pulp was substantially equivalent according to both of these alternatives.

The specific energy consumption, however, was reduced considerably by using the feeding device according to the present invention.

Figure 3:
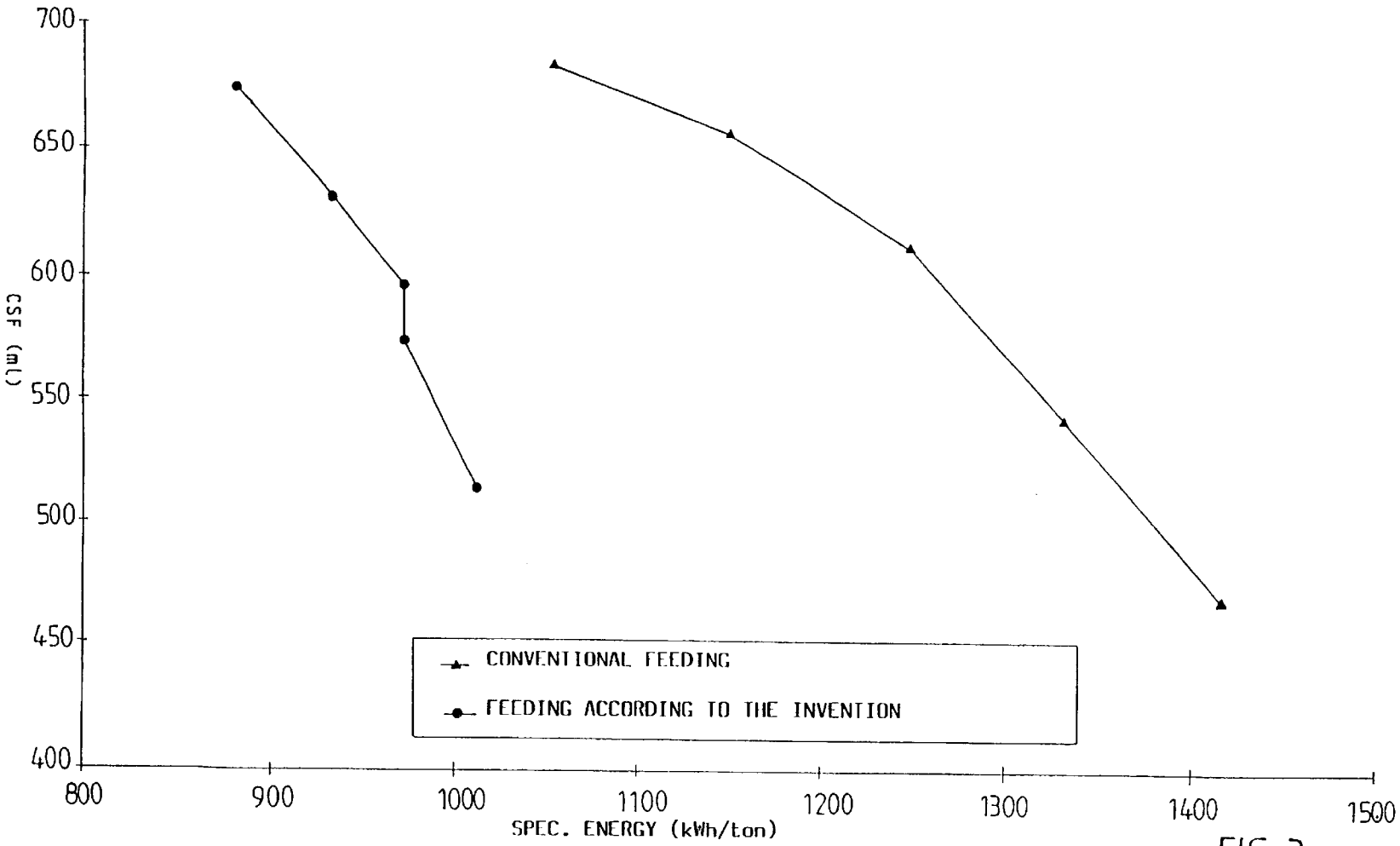
FIG. 3 is a diagram comparing experiments in which the freeness is set forth as a function of the energy consumption.

For a corresponding freeness value, a reduction of the energy consumption by about 25% was observed. See FIG. 3.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A method for refining lignocellulosic material between a pair of relatively rotary refining elements forming an annular outer refining zone and a central feed zone therebetween, said method including feeding said lignocellulosic material to said central feed zone at a first rate, accelerating said lignocellulosic material from said central feed zone into said annular outer refining zone at a second rate without lignocellulosic material build up in said central feed zone and substantially without working said lignocellulosic material in said central feed zone, the density of said lignocellulosic material in said central feed zone being a maximum of about 10 kg/m$^3$, said second rate being substantially greater than said first rate, and mechanically working said lignocellulosic material in said annular outer refining zone wherein said relatively rotary refining elements have a relative speed of greater than about 50 m/sec.

2. The method of claim 1 wherein said density of said lignocellulosic material in said central feed zone is a maximum of about 1 kg/m$^3$.

3. Apparatus for feeding lignocellulosic material to a refiner including a pair of relatively rotary refining members including a corresponding pair of refining elements forming a refining gap and comprising an annular outer refining zone, and a central feed zone therebetween, a central feed conduit having a predetermined diameter for feeding said lignocellulosic material to said refiner, said apparatus including a feed member for mounting in said central feed zone in front of said central feed conduit for feeding lignocellulosic material at a first rate, said feed member including a front axial screw and at least one substantially radial rear wing displaced rearwardly from said front axial screw for feeding lignocellulosic material at a second rate, said front axial screw having a diameter substantially corresponding to said predetermined diameter, and said at least one rear wing adapted to extend into said refining gap substantially to said annular outer refining zone.

4. The apparatus of claim 3 wherein said pair of relatively rotary refining members includes a stationary refining member and a rotary refining member, said central feed conduit being disposed in said stationary refining member and said feed member being disposed on said rotary refining member.

5. The apparatus of claim 4 including between about 2 and 4 of said substantially radial rear wing members.

6. The apparatus of claim 4 wherein said at least one rear wing member includes an outer end which is curved from the intended direction of rotation of said rotary refining member.

* * * * *